US005417330A

United States Patent [19]

Heyl

[11] Patent Number: 5,417,330

[45] Date of Patent: May 23, 1995

[54] APPARATUS FOR SEPARATING TRAMP MATERIAL FROM A PNEUMATIC CONVEYING SYSTGEM

[75] Inventor: Robert D. Heyl, Frisco, N.C.

[73] Assignee: The Young Industries, Inc., Muncy, Pa.

[21] Appl. No.: 991,498

[22] Filed: Dec. 17, 1992

Related U.S. Application Data

[63] Continuation of Ser. No. 719,363, Jun. 24, 1991, abandoned.

[51] Int. Cl.[6] ..... B07B 7/00

[52] U.S. Cl. ..... 209/140; 209/143; 209/154

[58] Field of Search ..... 209/140, 142, 141, 143, 209/154; 406/195

[56] References Cited

U.S. PATENT DOCUMENTS

| | | | |
|---|---|---|---|
| 1,231,478 | 6/1917 | Blankmann | 209/142 |
| 1,281,881 | 10/1918 | Thuneman | 209/143 |
| 2,638,217 | 5/1953 | Niemitz | 209/154 X |
| 3,398,829 | 8/1968 | Brown | 209/140 |

FOREIGN PATENT DOCUMENTS

| | | | |
|---|---|---|---|
| 828194 | 1/1952 | Germany | 209/140 |
| 934980 | 10/1955 | Germany | 209/140 |
| 385014 | 12/1932 | United Kingdom | 209/143 |

*Primary Examiner*—D. Glenn Dayoan
*Attorney, Agent, or Firm*—Lalos & Keegan

[57] ABSTRACT

An apparatus for separating tramp particles from comparatively lighter particles of product being conveyed, both entrained in a fluid stream within a pipeline of a pneumatic conveying system, generally comprising a passageway through which the fluid stream with the entrained particles is conducted, the fluid passageway including a section having a progressively increasing cross-sectional area whereby the velocity of the fluid stream is caused to decrease as it traverses through the passageway, a baffle disposed in the path of the fluid stream traversing through the passageway for laterally deflecting the fluid stream flowing at a reduced velocity whereby the tramp particles are caused to gravity fall from the fluid stream while the product particles remain entrained therein, and a receptacle for receiving the tramp particles discharged from the fluid stream.

15 Claims, 1 Drawing Sheet

APPARATUS FOR SEPARATING TRAMP MATERIAL FROM A PNEUMATIC CONVEYING SYSTGEM

This is a continuation of application Ser. No. 07/719,363 filed on Jun. 24, 1991, now abandoned.

BRIEF DESCRIPTION OF THE INVENTION

This invention relates to systems for pneumatically conveying various products such as powders, pellets, grains, flakes and the like, and more particularly to an apparatus for separating tramp materials entrained in a stream of such product flowing in such a system.

Conventional pneumatic conveying systems typically consist of a transporting pipeline, a product holding unit such as a bin, storage silo, blender or rail car from which the product is fed into the pipeline, a unit to which the product is transported such as another bin, storage silo, blender, rail car or possibly a processing unit and a means for pneumatically inducing the flow of the product through the pipeline. Generally, the pipeline is composed of a plurality of segments which usually are bolted together to provide the transporting means. Additional components such as airlocks, filters, valves and the like may be provided along the product circuit which are employed to perform various functions.

Because of the construction of such systems, it has been found that various components such as bolts, nuts, washers and the like, generally referred to in the industry as tramp materials, tend to dislodge or disengage from the pipeline and other components of such systems and become entrained in the product stream thus contaminating the product being transported and perhaps processed.

In the prior art, various methods have been employed for removing tramp materials from pneumatic conveying systems such screening, providing magnetic devices for extracting the materials and utilizing air separators. However, each of such methods have been found not to be effective in performance or cost effective in removing such materials. Screening is expensive and the product separated by screening must be removed from the air stream to accommodate the screening equipment. Magnetic devices are limited to the removal of material that is magnetically susceptible. In the chemical, pharmaceutical and food processing industries, the process equipment usually is constructed of aluminum or 300 series stainless steel to avoid corrosion. Tramp materials found in such systems are not magnetically susceptible and thus are not capable of being removed magnetically. Air separators usually require a separate air source and operate with a negative air pressure to draw air through the separator which often does not make such devices cost-effective. Accordingly, it is been found to be desirable to provide a means for removing tramp materials from pneumatic conveying systems which is both effective in performance and also cost-effective.

Accordingly, the principal object of the present invention is to provide a novel apparatus for removing tramp materials from pneumatic conveying systems.

Another object of the present invention is to provide a novel apparatus for removing tramp materials from pneumatic conveying systems which is passive in nature, not requiring any form of energy input.

A further object of the present invention is provide a novel apparatus for removing metallic tramp materials such as bolts, nuts, washers and the like from pneumatic conveying systems.

A still further object of the present invention is to provide a novel apparatus for removing tramp materials from pneumatic conveying systems capable in removing tramp materials which are not magnetically susceptible.

Another object of the present invention is to provide a novel apparatus for separating tramp materials from a fluid stream of a pneumatical conveying system which will not materially affect the flow of material being conveyed.

A further object of the present invention is to provide a novel apparatus for removing tramp materials from pneumatic conveying systems which may be adjusted to accommodate the removal of specific types of tramp materials.

A still further object of the present invention is to provide a novel apparatus for removing tramp materials from pneumatic conveying systems which is simple in design, effective in performance and cost-effective in operation.

Other objects and advantages of the present invention will become more apparent to those persons having ordinary skill in the art to which the present invention pertains from the following description taken in conjunction with the accompanying drawing wherein:

DETAILED DESCRIPTION

Figure 3:
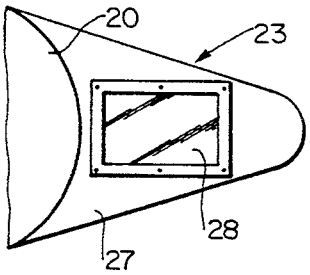
FIG. 3 is a cross-sectional view taken along line 3—3 in FIG. 1.
Figure 4:
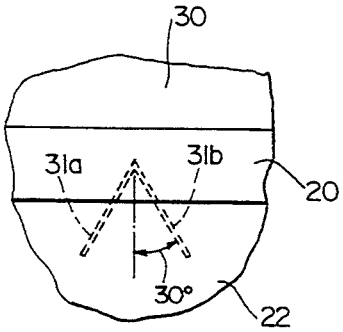
FIG. 4 is an enlarged fragmentary view taken along line 4—4 in FIG. 1.

Referring to the drawing, there is illustrated an apparatus 10 for removing tramp materials such as bolts, nuts, washers and the like from a stream of product being conveying in a pneumatic conveying system which embodies the present invention. The apparatus is adapted to be installed between a pair of segments of a transporting pipeline for conveying a fluid stream therethrough having product being conveyed and tramp materials entrained therein, and essentially consists of a lower assembly 11 and a upper assembly 12. The lower assembly includes a tubular member 13 adapted to be connected to a segment of the transporting pipeline of the system, a receptacle member 14 for collecting and discharging tramp material removed from the product stream flowing through the apparatus and a lower housing member 15. Tubular member 13 includes a cylindrical section 16 having a diameter substantially the same as an adjoining pipeline segment and an annular mounting flange 17 adapted to mate and be secured to a comparable flange of the adjoining pipeline segment, a transition section 18 and an upper flared section 19. The transition section provides an internal fluid passageway of increasing cross-sectional area whereby upon the flow of the fluid stream therethrough the velocity of the stream will decrease a sufficient amount so that upon the stream flowing out of the tubular member, the velocity of the stream will be sufficiently low so that tramp materials entrained in the stream will be caused to be removed from the stream by the force of gravity and drop into the receptacle member from which they would be discharged from the apparatus. The receptacle member includes a cylindrical wall 20 encompassing tubular member 13 and disposed coaxially relative thereto to provide an annular space 21, and a sloped bottom wall 22 also forming the bottom wall of a chute 23 which functions to guide removed tramp materials to a discharge tube 24. The chute further is provided with a pair of side walls 25 and 26 which interconnect and merge with the cylindrical wall surfaces of the receptacle member and discharge tubular member 24, and an upper wall 27 provided with a sight glass 28 to permit viewing of the interior of the chute. Discharge tube 24 further is provided with an annular mounting flange 29 which would permit the discharge tube to be connected to another component for conveying the removed tramp material elsewhere.

Lower housing member 15 includes an inverted, frusto-conically shaped section 30 secured at its lower end to the cylindrical wall of receptacle member 14 and a cylindrical section 31 formed on the upper end of section 30. The diameter of the lower end of section 30 is greater than the diameter of the upper end of transition section 18 to provide an annular space 32 between the upper flaring portion 19 of the tubular member and section 30 of the lower housing member to permit the passage of tramp material gravity falling from the product stream emanating from the tubular member and passing through a separation zone or chamber 33. The upper end of cylindrical section 31 is provided with an annular mounting flange 34 for securing the lower assembly to the upper assembly.

Upper assembly 12 of the apparatus consists of a tubular member 35, an upper housing member 36, a stationary baffle member 37 disposed within upper housing member 36 and a movable baffle member 38 disposed within stationary baffle member 37 and displaceable relative thereto and relative to tubular member 13. Upper housing member 36 includes a cylindrical section 39 having an annular mounting flange 40 seated on and secured to mating mounting flange 34 by means of a set of bolts, and a frusto-conically configured section 41 formed integral with the upper end of cylindrical section 39. Tubular member 35 is formed integral with the upper end of upper housing member 36 and includes an annular mounting flange 42 comparable to mounting flange 17 for securing the apparatus to another pipeline segment of a pneumatic conveying system, and an annular support flange 43 spaced from mounting flange 42.

Upper housing member 36 is provided with a set of circumferentially spaced openings in which there is inserted a set of guide tubes 44. Each of such tube members is rigidly secured to upper housing member 36 and is provided with an adjusting screw 45 which is threaded into a threaded opening in annular support flange 43. The screws further are provided with pairs of nuts 46 and 47 which can be backed off and run up against flange 43 and the upper ends of tubular members 44 for axially displacing movable baffle 38.

Stationary baffle member 37 is provided with an upper conical section 48 disposed coaxially relative to tubular member 13, lower and upper housing members 15 and 36 and tubular member 35, and a cylindrical section 49 also disposed coaxially relative to such members. Cylindrical section 49 is spaced from cylindrical section 39 to provide an annular fluid passageway 50, and conical section 48 is spaced from frusto-conical section 41 of the upper housing member to provide an annular fluid passageway 51 intercommunicating fluid passageway 50 and fluid passageway 52 of tubular member 35. Conical section 48 further is provided with circumferentially spaced openings through which guide tubes 44 are received. The stationary baffle member 37 is supported by means of the conical section thereof being secured to and depending from guide tubes 44.

Figure 1:
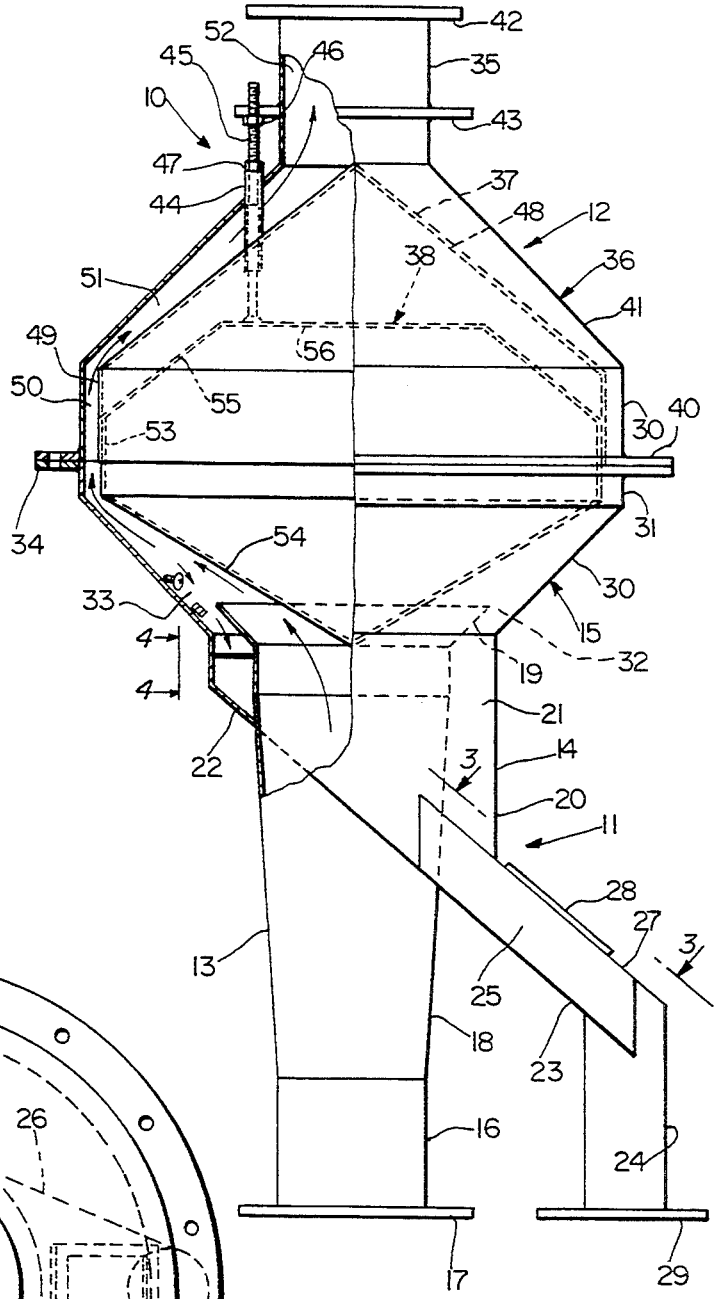
FIG. 1 is a front elevational view of a tramp material separator of a pneumatic conveying system, embodying the present invention.
Figure 2:
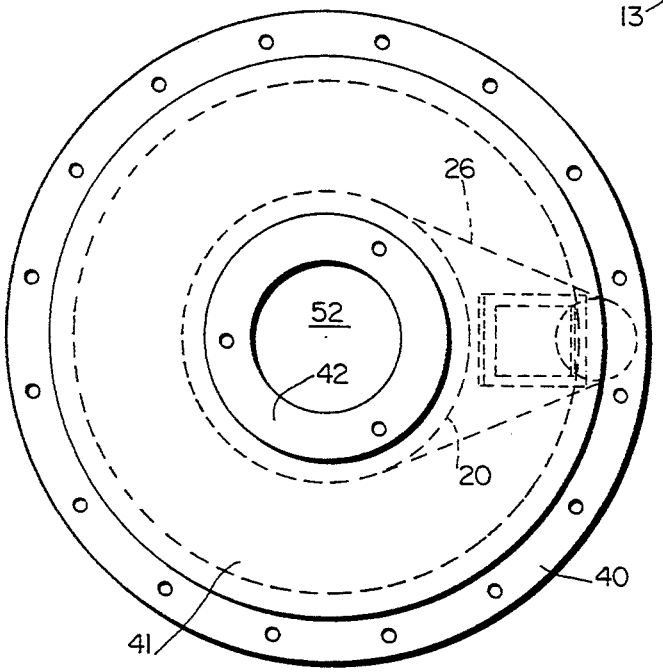
FIG. 2 is a top plan view of the embodiment shown in FIG. 1.

Movable baffle member 38 is disposed and displaceable axially relative to stationary baffle member 37 and includes a cylindrical side wall section 53 an inverted, conical section 54 and an upper frusto-conical section 55 and an upper wall section 56. As best shown in FIG. 1, the movable baffle member is secured to and depends from the lower ends of adjusting screws 45, the side wall section 53 is disposed adjacent to side wall section 49 of the stationary baffle member and the conical section 54 is adapted to be received within flaring portion 19 of tubular member 13 to permit the movable baffle section to be displaced axially within the stationary baffle section and the outlet of tubular member 13 to correspondingly vary the effective cross-sectional area of the outlet of the tubular member and the cross-sectional area of separation chamber 33.

In operation, when the apparatus as described has been installed in the transporting pipeline of a pneumatic conveying system, a fluid stream having product being conveyed and perhaps tramp materials entrained therein, is caused to flow through tubular member 13, be deflected by movable baffle member 38 laterally through separation zone or chamber 33, flow through annular chambers 50 and 51 and be recombined in passageway 52 of tubular member 35. As the fluid stream traverses through transition section 18 of tubular member 13, the velocity thereof will be caused to decrease as the cross-sectional area thereof increases. The tubular member is sized in a manner whereby the velocity of the fluid stream will decrease sufficiently by the time that the fluid stream emanates from the transition section and enters separation chamber 33 so that the heavier tramp materials in the fluid stream will be caused to gravity fall out of the separation chamber and be guided downwardly through the receptacle unit and be discharged through discharge tube 24. The effective cross-sectional area of the outlet portion of transition section 18 and the separation chamber 33 may be varied by axially displacing movable baffle member 38 within and relative to stationary baffle member 37. Devoid of tramp material, the divided fluid stream with the product being conveyed still entrained therein will flow through passageways 50 and 51 and be recombined in passageway 52. As the fluid stream traverses such passageways and the cross-sectional areas thereof are reduced, the velocity of the fluid stream will increase to a velocity approaching the inlet velocity of the fluid stream.

As best shown in FIG. 1, tramp material separated from fluid stream will be caused to deposit on frusto-conically configured section 30 of the lower housing member and be guided downwardly through annular opening 32 onto lower wall 22 of the collector unit and chute 23 from where it is discharged through tubular member 24. The receptacle member provides a trough about the tubular member for collecting the tramp materials. Materials deposited in the trough on the side opposite the chute are deflected around the tubular member by a pair of deflecting plates 31*a* and 31*b*.

The combination of the decrease of the fluid stream velocity as the fluid stream traverses through transition section 13 and the deflection of the stream as it impinges upon movable baffle member 38 causes the heavier tramp materials to be removed from the fluid stream which is incapable of continuing to entrain such materials due to the decrease in velocity of the fluid stream. The impact of product entrained in the fluid stream with the movable baffle member further functions to break apart any product which may have been caused to adhere together such as plastic pellets.

For most products being conveyed and for typical tramp materials incurred, separation of the tramp materials from the product being conveyed can be accomplished through a proper sizing of the transition zone to provide the required decrease in velocity of the fluid stream to effect removal of the undesirable materials. The movable baffle member, however, not only functions to deflect the fluid stream to facilitate the removal of the tramp materials but also may be displaced relative to tubular member 13 to vary the effective cross-sectional area of the outlet of the tubular member and the separation chamber to accommodate the removal of a variety of types of tramp materials. In practice, the movable baffle member would be adjusted to provide the optimum results with respect to the particular tramp material sought to be removed.

In a typical application in which the velocity of the fluid stream entering the type of apparatus as shown, would be 5,000 feet per minute (fpm). The cross-sectional area of cylindrical section 16 would be approximately 31.7 square inches, and the cross-sectional area of the upper end of the transition section 18 would be approximately 54.5 square inches, resulting in a decrease in velocity of the fluid stream to 2,900 fpm. At such a velocity, metallic particles such as bolts, nuts and washers will be caused to be removed from the fluid stream as it traverses through the separation chamber so that such particles will be deposited on wall section 30 to be guided downwardly and discharged from the apparatus. As the fluid stream continues to flow upwardly through the apparatus the velocity of the fluid stream will be sufficient to maintain the product being conveyed entrained therein, and will increase slightly as it traverses passageways 50 and 51 until it recombines in passageway 52 having a cross-sectional area similar to the cross-sectional area of tube section 16, where the velocity of the fluid stream will increase to about 5,000 as it leaves the apparatus and continues in the system. By axially displacing the movable baffle member, the velocity of the fluid stream passing through the separation chamber may be varied between 1,000 to 3,000 fpm to permit the removal of a wide variety of tramp materials from the fluid stream.

Since the apparatus as described is passive in nature, no energy input is required and any type of suitable material may be used to fabricate the various components of the system.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for passively separating tramp particles from comparatively light particles of product being conveyed, both entrained in a fluid stream within a pipeline of a pneumatic conveying system comprising:

means defining a passageway through which a product fluid stream is conducted, said fluid passageway including a tubular member and a housing section, said tubular member having a progressively increasing cross-sectional area to decrease the velocity of said fluid stream traversing therethrough, said fluid stream entering said tubular member at a first velocity and emanating from said tubular member at a second reduced velocity less than said first velocity;

deflecting means disposed within said housing section and projecting into said tubular member so as to interrupt the path of said fluid stream traversing said passageway and laterally deflect said fluid stream flowing at said second reduced velocity whereby said tramp particles are caused to gravity fall from said fluid stream while said comparatively lighter particles remain entrained therein; and means defining a receptacle for receiving said tramp particles removed from said fluid stream.

2. An apparatus according to claim 1 including means for discharging said tramp particles from said receptacle.

3. An apparatus according to claim 1 wherein said first velocity is 5,000 fpm and said passageway is sized to decrease said velocity to said second reduced velocity in the range of 1,000 to 3,000 fpm.

4. An apparatus according to claim 1 wherein said first velocity is 5,000 fpm and said passageway is sized to decrease said velocity from 5,000 fpm to said second reduced velocity of 2,900 fpm.

5. An apparatus according to claim 1 wherein said means defining said passageway includes means for securing said apparatus to components of said pneumatic conveying system as an integral component thereof.

6. An apparatus according to claim 1 wherein said deflecting means is displaceable relative to an outlet of said said tubular member for varying the effective cross-sectional area of said outlet to correspondingly vary said second reduced velocity.

7. An apparatus according to claim 1 wherein said housing includes a downstream section of progressively decreasing cross-sectional area whereby the velocity of said fluid stream devoid of tramp particles will be caused to increase as it traverses therethrough.

8. An apparatus according to claim 1 wherein said housing section is frusto-conically configured and said deflecting means has an inverted, conical configuration whereby said fluid stream emanating from said tubular member is caused to be deflected laterally.

9. An apparatus according to claim 8 wherein said receptacle comprises a trough disposed about said passageway.

10. An apparatus according to claim 9 wherein said trough is provided with an inclined bottom wall for guiding removed tramp particles downwardly and outwardly.

11. An apparatus according to claim 10 including a chute for receiving removed tramp particles from said trough and guiding them outwardly therefrom.

12. An apparatus according to claim 8 wherein said deflecting means is displaceable relative to said tubular member, along a common centerline thereof whereby upon displacement of said deflecting means the effective area of the outlet of said tubular member will vary to correspondingly vary said second reduced velocity.

13. An apparatus according to claim 12 wherein the outlet of said passageway section is provided with a flared portion adapted to receive said deflecting means therein.

14. An apparatus according to claim 8 wherein said passageway includes a downstream section of progressively decreasing cross-sectional area whereby the velocity of said fluid stream devoid of tramp particles will be caused to increase as it traverses therethrough.

15. An apparatus according to claim 8 wherein said passageway section is configured and said deflecting means is adapted to be displaceable sufficiently to provide a velocity of the fluid stream emanating from said passageway section and traversing a separation chamber in the range of 1,000 to 3,000 fpm.

* * * * *